US006954200B2

(12) United States Patent
Kim

(10) Patent No.: US 6,954,200 B2
(45) Date of Patent: Oct. 11, 2005

(54) FLAT PANEL DISPLAY

(75) Inventor: Haeng-Seon Kim, Kyongki-do (KR)

(73) Assignee: Samsung Electronics Co., Ltd., Suwon (KR)

( * ) Notice: Subject to any disclaimer, the term of this patent is extended or adjusted under 35 U.S.C. 154(b) by 173 days.

(21) Appl. No.: 09/912,500

(22) Filed: Jul. 26, 2001

(65) Prior Publication Data

US 2002/0011999 A1 Jan. 31, 2002

(30) Foreign Application Priority Data

Jul. 27, 2000 (KR) ..... 2000-43406

(51) Int. Cl.[7] ..... G09G 5/00
(52) U.S. Cl. ..... 345/204; 345/98
(58) Field of Search ..... 345/87, 93, 94, 345/95, 96, 98, 204, 205, 211

(56) References Cited

U.S. PATENT DOCUMENTS 6,229,513 B1 * 5/2001 Nakano et al. ..... 345/99
6,356,260 B1 * 3/2002 Montalbo ..... 345/204
6,388,653 B1 * 5/2002 Goto et al. ..... 345/98
6,480,180 B1 * 11/2002 Moon ..... 345/98

* cited by examiner

*Primary Examiner*—Henry N. Tran
*Assistant Examiner*—Jean Lesperance
(74) *Attorney, Agent, or Firm*—McGuireWoods LLP

(57) ABSTRACT

A flat panel display comprises a system and a display module. The system comprises an image processing part for deciding a timing format of an image data and generating a control signal for the image data, an encoder for encoding the data and the control signal output from the image processing part in an RSDS specification, and a power output part for outputting a constant-voltage. The display module includes a column driver integrated circuit and a scan driver integrated circuit, and the decoding of the encoded image data and the control signal are performed at a decoder of the column driver integrated circuit and the scan driver integrated circuit.

29 Claims, 3 Drawing Sheets

FLAT PANEL DISPLAY

BACKGROUND OF THE INVENTION

1. Field of the Invention

The present invention relates to a flat panel display, and more particularly, to a flat panel display having a display module to which a control signal and image data are transmitted by a reduced swing differential signaling (hereinafter referred to as "RSDS") specification, a timing format of the image data and the control signal for the image data are generated before the control signal and data are transmitted to a control board of the display module. Then, the data are applied to a driver integrated circuit, thereby transmitting the data at a high speed without an electromagnetic interference (EMI).

2. Description of the Related Art

Recently, flat panel displays are remarkably advanced with the developments in liquid crystal display and plasma display technologies. Thus, flat panel displays such as liquid crystal display or plasma display are employed as the monitor for products such as a personal computer or a television receiver.

Especially, liquid crystal displays (LCDs) display a picture using electrical and optical properties of liquid crystal and their developments are being directed toward a trend pursuing a higher resolution and a larger screen size. These LCDs include a flat LCD panel displaying a picture, a control board connected to the LCD panel, an optical module and a mold frame receiving these elements.

Generally, when LCDs are developed to have a screen size larger than XGA level, there occurs a problem in achieving high resolution due to EMI problem, noise through transmitting medium and limitation in size of transmission data.

Also, an LCD that transmits data or clock signals at transistor-transistor logic (TTL) level, requires a large number of transmission lines, which increases the number of cables or connectors. As a result, the LCD becomes increasingly exposed to external noise sources. Further, a long transmitting distance delays a signal, which degrades a picture quality.

Plasma displays as well as LCDs have the same problem.

In order to solve the aforementioned problems, a current technology for a larger screen sized LCD is developed to transmit data in a high speed, to reduce the EMI problem, and to decrease the number of transmission lines. The low voltage differential signaling (hereinafter referred to as "LVDS") specification and RSDS specification are such technologies.

However, the LVDS or RSDS specification needs a procedure in which a data signal transmitted into the display module is decoded to have a TTL level, and the decoded signal having the TTL level is encoded to have LVDS specification or RSDS specification on the control board. To this end, in these LVDS and RSDS specifications, the control board needs to have devices for performing such signal conversions. Thus, the increased number of elements makes the control board more complicated.

SUMMARY OF THE INVENTION

Accordingly, it is an object of the present invention to optimize and simplify the structure of the display module in a flat panel display by timing formatting an original signal and a control signal that are output from an image supplying source and directly transmitting the timing-formatted signals to the column/scan driver integrated circuits prior to transmitting to the control board the original data and the control signal.

It is another object to selectively perform the aforementioned object in an analog-formatted signal or a digital-formatted signal.

According to an aspect of the present invention, there is provided a flat panel display comprising a system and a display module. The system includes an image processing part for deciding a timing format of an image data and generating a control signal for the image data, an encoder for encoding the image data and the control signal output from the image processing part in an RSDS specification, and a power output part for outputting an constant voltage. The display module includes a control board including a power supply part for converting the constant voltage of the power output part into a predetermined voltage level, a gray scale generating part for generating a gray scale voltage using the predetermined voltage level of the voltage converting part, a gate voltage generating part for generating a gate on/off voltage using the predetermined voltage level of the voltage converting part, and a transmission line for transmitting the encoded image data and the control signal; a first connecting member having a column driver means for generating a column signal when the image data, the control signal and the gray scale voltage are applied; a second connecting member having a scan driver means for generating a scan signal when the control signal and the gate on/off voltage are applied; and a flat panel for forming a picture using the scan signal and the column signal.

BRIEF DESCRIPTION OF THE DRAWINGS

The above objects and other advantages of the present invention will become more apparent by describing in detail a preferred embodiment with reference to the attached drawings in which.

DETAILED DESCRIPTION OF THE PREFERRED EMBODIMENTS

The present invention now will be described more fully hereinafter with reference to the accompanying drawings, in which preferred embodiments of the invention are shown. This invention may, however, be embodied in many different forms and should not be construed as limited to the embodiments set forth herein.

Figure 1:
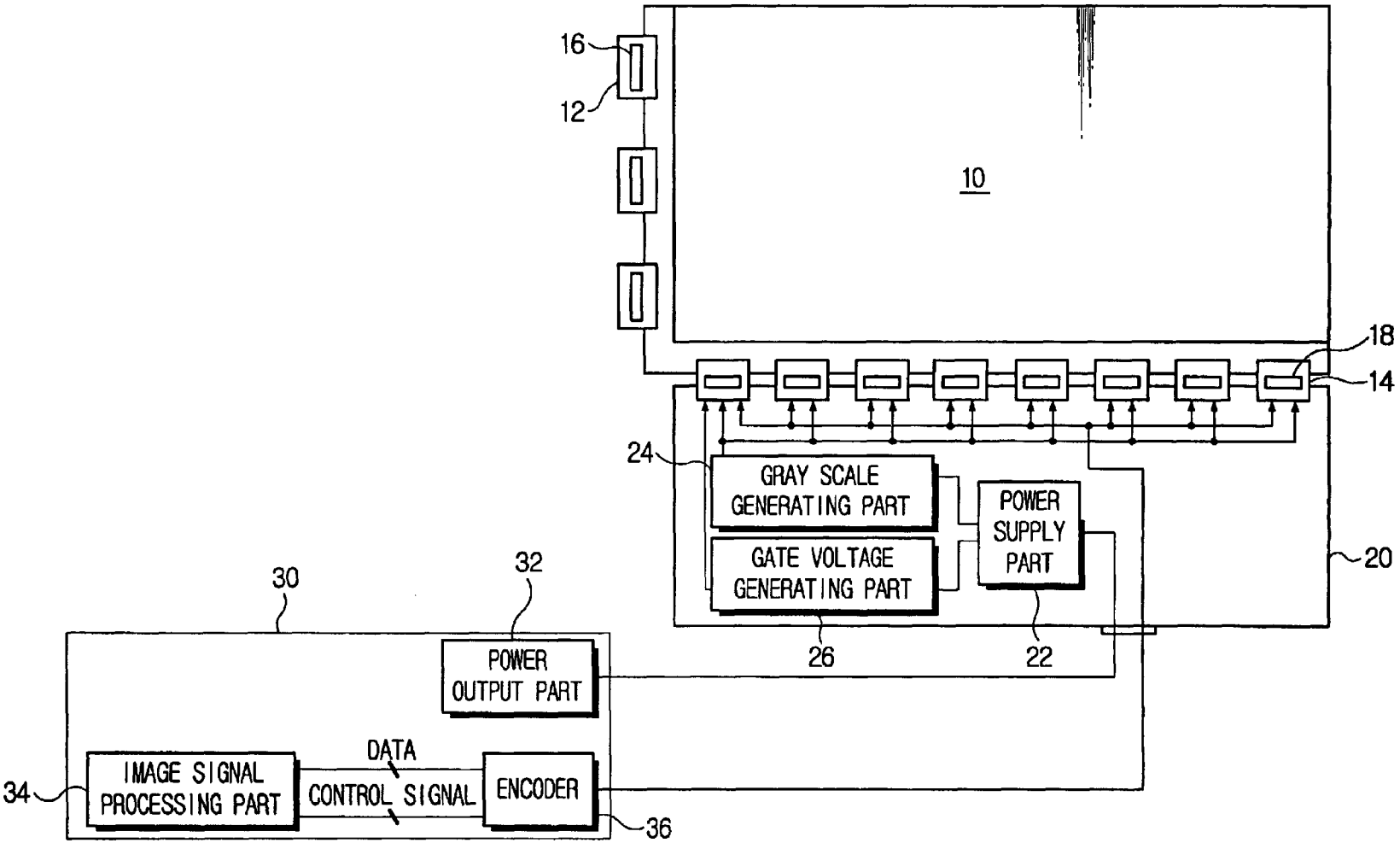
FIG. 1 is a schematic diagram of a flat panel display in accordance with one preferred embodiment.
Figure 3:
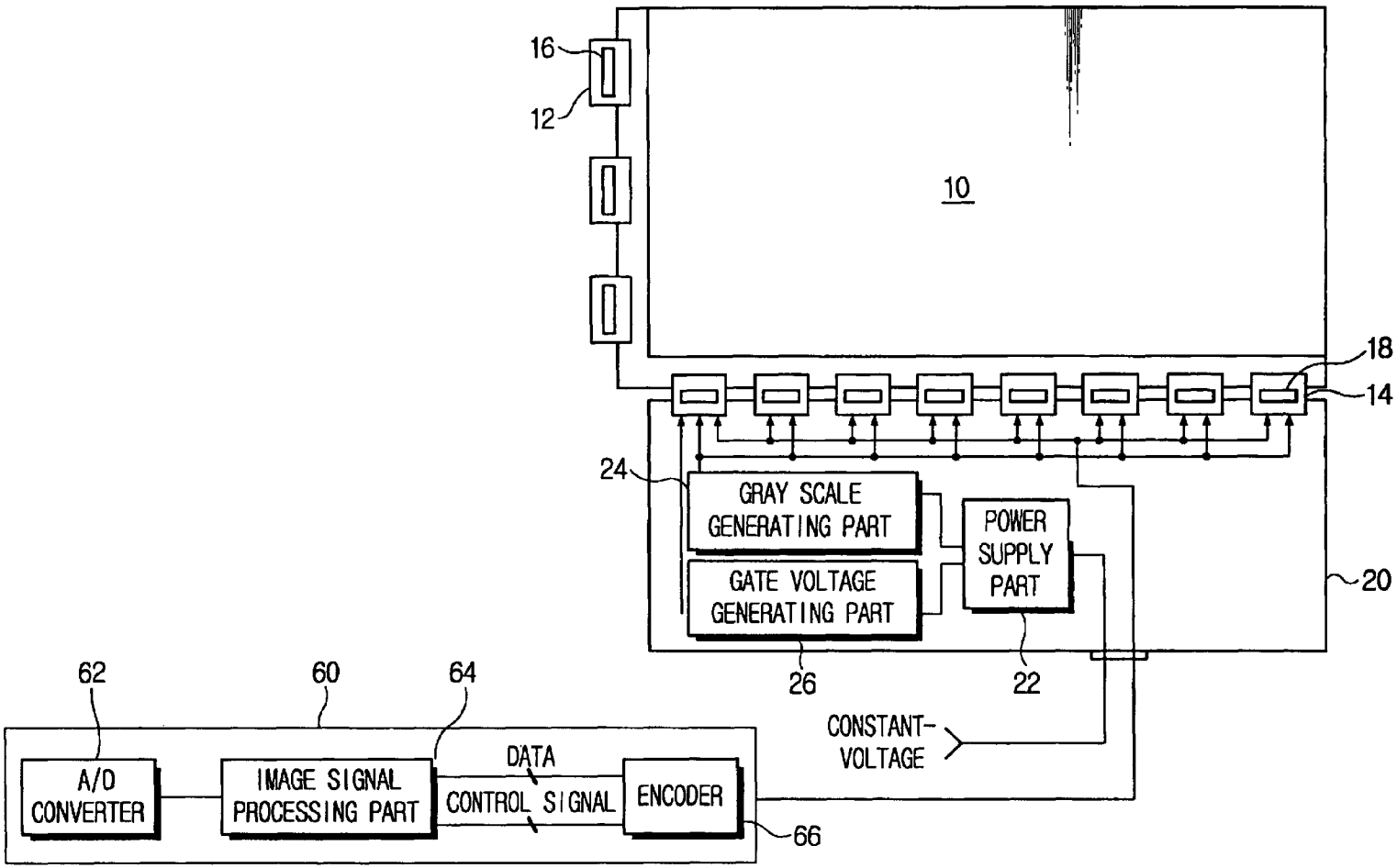
FIG. 3 is a schematic diagram of a flat panel display in accordance with another preferred embodiment.

The present embodiments are constituted to timing format an original signal transmitted in a digital format. Then, it generates a control signal for the original signal and directly transmits the timing-formatted original signal and the control signal to the column/scan driver integrated circuits. They are sent before transmitting to the control board the original data and the control signal. To this end, a first embodiment of FIG. 1 illustrate a case of when the original signal and the control signal are in a digital format while a second embodiment of FIG. 3 illustrates a case of when the original signal and the control signal are in an analog format. Also, the first and second embodiments are described with reference to an example of LCDs as a flat panel display.

First, referring to FIG. 1, a display module includes an LCD panel 10, a connecting member 12 and 14 electrically and physically connected to the LCD panel 10, and a control board 20. A system 30 includes a power output part 32, an image processing part 34 and an encoder 36.

LCD panel 10 includes a color filter substrate, a TFT substrate facing with the color filter substrate, and a liquid crystal interposed between the color filter substrate and the TFT substrate. Liquid crystal changes its physical properties when a voltage is applied between the color filter substrate and the TFT substrate, so that liquid crystal selectively transmits incident light beams to display an image. The connecting members 12 and 14 are respectively connected to an end portion of the TFT substrate and another end portion of the TFT substrate.

On the connecting member 12, there is mounted a scan driver integrated circuit 16 for applying a scan signal to the gate of thin film transistor formed in each pixel of the LCD panel 10. On the connecting member 14, there is mounted a column driver integrated circuit 18 for applying a column signal to the source of thin film transistor formed in each pixel of the LCD panel 10. Here, the connecting members 12 and 14 may be made of a flexible printed circuit board and are physically and electrically coupled to the LCD panel 10 and/or the control board 20 by an attaching member such as an anisotropic conductive film.

The connecting member 14 includes an input transmission line for applying an electrical signal input from the control board 20 to the column driver integrated circuit 18 and an output transmission line for applying its output signal to the LCD panel 10.

The connecting member 12 also includes an input transmission line for applying an electrical signal input via an edge of the LCD panel 10 to the scan driver integrated circuit 16 and an output transmission line for applying its output signal to the LCD panel 10.

The control board 20 includes a power supply part 22, a gray scale generating part 24, a gate voltage generating part 26 formed thereon. Also, on the control board 20, there are formed various transmission lines for applying a gray scale voltage, a gate voltage, applying a power supplied from the system 30 to the power supplying part 22, and applying an image data and a control signal for the image data to the connecting member 14.

Here, the power supply part 22 is constituted to generate and output a necessary direct current (DC) voltage for the aforementioned elements using a power supplied from the system 30. The gray scale generating part 24 is constituted to generate various levels of gray scale voltages for displaying a gray scale using a power supplied from the power supply part 22 and supply the generated gray scale voltages to the column driver integrated circuit 18. The gate voltage generating part 26 is constituted to generate a gate on/off voltage using a power supplied from the power supply part 22 and supply the generated gate on/off voltage to the scan driver integrated circuit 16 on the connecting member 12.

Here, the gate on/off voltage is applied to the scan driver integrated circuit 16 via transmission lines formed on the connecting member 14 and an edge of the LCD panel 10.

Meanwhile, in the system 30 provided with a digital processor such as the computer, an original TTL image signal having a digital format and a control signal for the image signal are generated from the image signal processing part 34. The original TTL image signal includes 6-bit or 8-bit image data (total 18-bit or 24-bit) per colors of red (R), green (G) and blue (B). The control signal may include a horizontal synchronous signal, a vertical synchronous signal, an enable signal, and so on.

The original TTL image signal and the control signal for the image signal both output from the image processing part 34 are transmitted to the encoder 36 and are converted into RSDS signals having plural channels. The encoder 36 transmits the converted RSDS signals to the control board 20 through a cable (not shown).

The power output part 32 converts the power supplied for the operation of the system 30 into voltages necessary for the display module and supplies the converted voltages to the power supplying part 22 of the control board 30 through a cable (not shown).

In the aforementioned first embodiment, the image processing part 34 generates the original image data and the control signal and then controls a timing format of the image data. Also, the image processing part 34 divides or changes the control signal.

Thus, the timing-controlled 6-bit or 8-bit image data per R, G, B are input at a TTL level to the encoder 36 and plural driving control signals are also input to the encoder 36.

The encoder 36 mixes the image data with the control signal to transmit the mixed signal through a single channel or transmit the image data and the control signal through their respective corresponding channels.

The image data and the control signal output from the encoder 36 are then transmitted to the control board 20 and are applied to respective corresponding connecting members 14 via interconnection lines formed on the control board 20. The connecting members 14 apply the input image data and the control signal to the respective corresponding column driver integrated circuits 18. The control signal includes a scan control signal for the scan driver integrated circuit 16. The scan control signal is transmitted to the scan driver integrated circuit 16 via an edge of the connecting member 14, an edge of the LCD panel 10 and an edge of the connecting member 12 in the named order.

The column driver integrated circuit 18 and the scan driver integrated circuit 16 should be constituted to have a means for converting an RSDS signal into a TTL signal therein. Therefore, the converted TTL data and the control signal are again converted into a column signal and a scan signal by the column driver integrated circuit 18 and the scan driver integrated circuit 16 and are then output.

Figure 2:
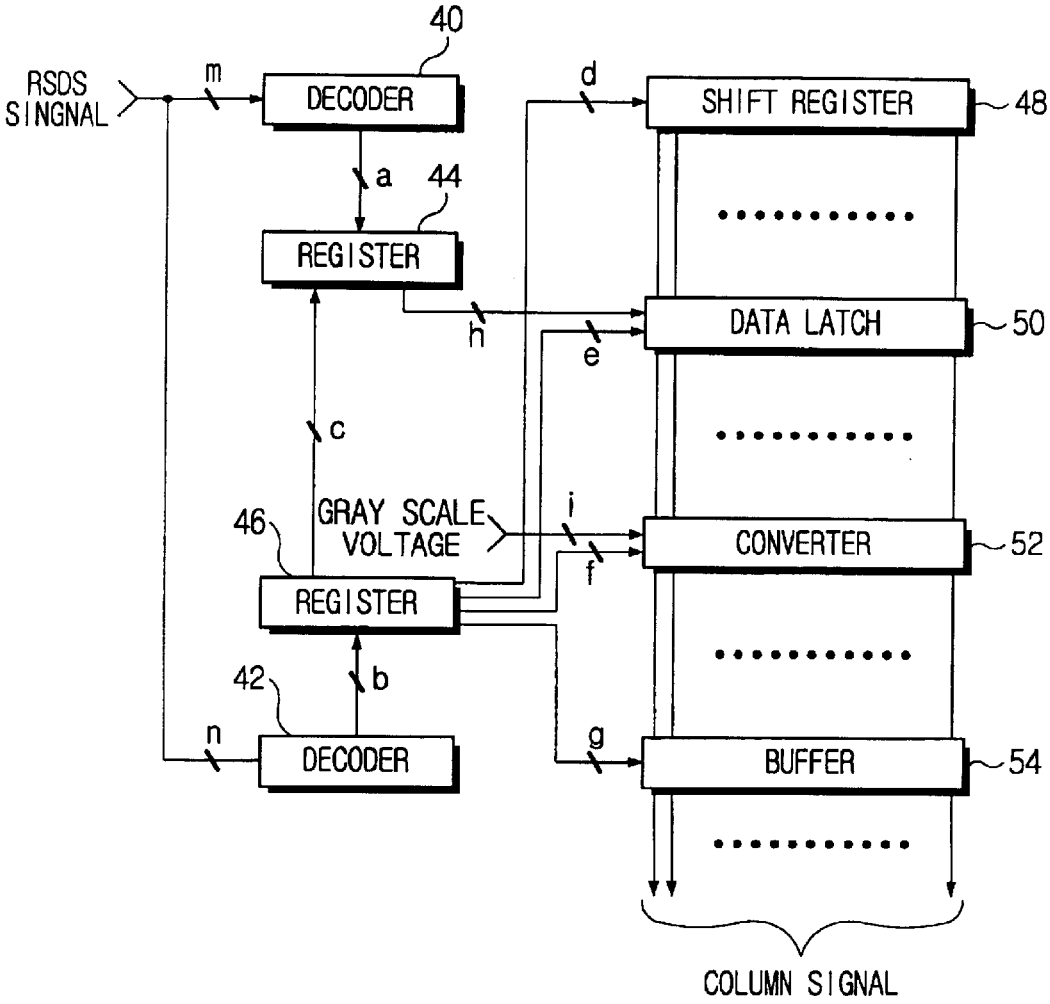
FIG. 2 is a block diagram showing a column driver integrated circuit in the flat panel display of FIG. 1.

FIG. 2 shows a block diagram of the column driver integrated circuit 18 for decoding an RSDS signal into a TTL signal.

Referring to FIG. 2, the column driver integrated circuit 18 includes a first decoder 40 for decoding an image data and a second decoder 42 for decoding a control signal.

The decoded TTL data "a" decoded by the first decoder 40 are temporarily stored in a first register 44 and the decoded TTL data "b" decoded by the second decoder 42 are temporarily stored in a second register 46.

In a case the data and the control signal are transmitted through respective corresponding channels, the first decoder 40 and the first register 44 are connected to a data transmission channel and the second decoder 42 and the second register 46 are connected to a control signal transmission channel to decode and store data.

Unlike the above case, in a case the data and the control signal are transmitted in a mixed state through a single channel, enable timings of the first and second registers 44 and 46 are controlled to distinguish the data from the control signal upon decoding and storing.

Accordingly, the second register 46 outputs a control signal "c" for controlling data output, and the output control signal "c" enables or disables the first register 44. The second register 46 also outputs control signals "d," "e," "f" and "g" to a shift register 48, a data latch 50, a converter 52 and a buffer 54. The shift register 48 orderly outputs shifted outputs to the data latch 50. The data latch 50 latches the data output from the first register 44 in a unit of pixel. Data per pixel temporarily stored in the data latch 50 are applied to the converter 52 and the converter 52 selects a gray scale voltage corresponding to data per pixel among gray scale voltages input from the gray scale generating part 24 and outputs the selected gray scale voltage to the buffer 54. The buffer 54 outputs a plurality of column signals at the same time.

Like the column driver integrated circuit 18 of FIG. 2, the scan driver integrated circuit 16 includes a decoder and a register. The scan driver integrated circuit 16 decodes a control signal having the RSDS specification to control outputs of the shift register, the level shifter and buffer (not shown). As a result, the scan driver integrated circuit 16 outputs a scan signal to the LCD panel 10 using the control signal having the RSDS specification and the gate on/off voltage supplied from the gate voltage generating part 26.

As a result, the image data and the control signal for the image data are encoded at the system 30 and are transmitted with the RSDS specification. When compared with data transmission of the TTL level, the number of the transmission lines decreases and high-speed data transmission driven by lower power is achieved. Also, electromagnetic hindrance is effectively prevented.

Further, without decoding the data and the control signal on the control board 20, signals having RSDS specification are directly transmitted to the column driver integrated circuit 18 and the scan driver integrated circuit. Decoding of the image data and the control signal are performed by the column driver integrated circuit 18 and the scan driver integrated circuit 16, and timing-formatted data and control signal generated previously in the system are applied for the output of column signal and scan signal. Therefore, it is unnecessary to mount elements for encoding and decoding data and control signal on the control board 20 and to design these elements. Thus, the mounting area of the control board 20 is minimized and the structure of the circuit for the control board is simplified.

The aforementioned embodiment is applied to a system having a microprocessor as the main system of a personal computer and a digital signal output.

Unlike the above embodiment, a system that displays an image by receiving a radio wave of analog format requires an analog/digital converter shown in FIG. 3. In this case, the system has a constitution different from that of FIG. 1.

Referring to FIG. 3, LCD panel 10, scan driver integrated circuit 16, column driver integrated circuit 18, connecting member 12 and 14 and control board 20 have the same constitution as those of the first embodiment. Gray scale generating part 24, gate voltage generating part 26 and power supplying part 22 mounted on the control board 20 have the same constitution as those of the first embodiment. So, their descriptions for the constitution and operation are omitted.

An original image signal and a control signal for the image signal both transmitted in an analog format are input to an analog/digital converter (hereinafter referred to as "A/D converter") 62 and are converted into TTL signals. A/D converter 62 is mounted on a signal converting board 60 which is different from the control board 20 of the first embodiment. The signal converting board 60 can be made of a printed circuit board or a flexible printed circuit board of resin. Signals are interfaced between the signal converting board 60 and the control board 20 using a cable matching the format of data to be transmitted.

A/D converter 62 converts an input analog signal into a digital signal, i.e., TTL signal and outputs the converted TTL signal to an image processing part 64. The image processing part 64 controls a timing format of the data. The image processing part 64 also generates a synchronous control signal necessary for the picture display using the original control signal and outputs the image data and the control signal for the image data to an encoder 66. The encoder 66 encodes the input image data and the control signal into image data and control signal having RSDS format and transmits the encoded image data and control signal to the column driver integrated circuit 18 and the scan driver integrated circuit 16 via the control board 20 like the first embodiment.

The encoder 66 mixes the image data with the control signal to transmit the mixed signal through a single channel or transmit the image data and the control signal through their respective corresponding channels. Thereafter, the column driver integrated circuit 18 and the scan driver integrated circuit 16 are operated like the first embodiment and accordingly the scan signal and the column signal are transmitted to the LCD panel 10.

The aforementioned second embodiment also transmits the image data and the control signal in RSDS format. As a result, the number of the transmission lines decreases and thereby low power operation, high speed data transmission and prevention of EMI problem are effectively achieved.

Also, it is unnecessary to mount elements for encoding and decoding data and control signal on the control board 20 and to design these elements. Thus, the mounting area of the control board 20 is minimized and the circuit structure for the control board is simplified.

As described above, a flat panel display of the present invention generates the timing-formatted image data and the control signal and transmits them in RSDS format. These image data and control signal are directly transmitted to the column driver integrated circuit and the scan driver integrated circuit via the control board. As a result, the present invention has advantages in that the display module is optimized and the circuit constitution is simplified. In addition, the simplified control board in an LCD module eliminates an EMI problem. Moreover, low power operation and high speed data transmission are effectively achieved.

This invention has been described above with reference to the aforementioned embodiments. It is evident, however, that many alternative modifications and variations will be apparent to those having skills in the art in light of the foregoing description. Accordingly, the present invention embraces all such alternative modifications and variations as fall within the spirit and scope of the appended claims.

What is claimed is:

1. A flat panel display, comprising:

a system including an image processing part that decides a timing format of an image data and generates a control signal for the image data, an encoder that encodes the image data and the control signal output from the image processing part into a RSDS specification, and a power output part that outputs a constant-voltage;

a display module in electrical communication with the system, said display module comprising:

a control board including a power supply part that converts the constant-voltage of the power output part into a predetermined voltage level;

a gray scale generating part that generates a gray scale voltage using the predetermined voltage level of the voltage converting part;

a gate voltage generating part that generates a gate on/off voltage using the predetermined voltage level of the voltage converting part;

a transmission line that transmits the encoded image data and the control signal;

a first connecting member having a data driver that converts the RSDS specification into TTL data that generates a column signal when the image data, the control signal, and the gray scale voltage are applied;

a second connecting member having a scan driver that generates a scan signal when the control signal and the gate on/off voltage are applied; and a flat panel that forms a picture using the scan signal and the column signal.

2. The flat panel display of claim 1, wherein said data driver comprises:

a first decoding unit that decodes the data and the control signal into the TTL data;

a first register unit that temporarily stores the TTL data decoded by the first decoding unit; and a first signal processing unit that generates and outputs a column signal using the TTL data stored in the first register unit, the control signal and the gray scale voltage.

3. The flat panel display of claim 2, wherein the data and the control signal are transmitted in a mixed signal within a single channel and after being decoded by the first decoding unit the TTL data is divided to be stored at a first register and a second register of the first register unit and is output to the first signal processing unit.

4. The flat panel display of claim 2, wherein the data and the control signal are separately transmitted through respective corresponding channels and after being respectively decoded by a first decoder and a second decoder of the first decoding unit the TTL data is divided to be stored at a third register and a fourth register of the first register unit and output to the first signal processing unit.

5. The flat panel display of claim 1, wherein said scan driver comprises:

a second decoding unit that decodes the control signal;

a second register unit that temporarily stores the control signal decoded by the second decoding unit; and a second signal processing unit that generates a scan signal using the control signal stored in the second register unit and the gate on/off voltage.

6. The flat panel display of claim 1, wherein encoder mixes the image data with the control signal to transmit a mixed single through a signal channel.

7. The flat panel display of claim 1, further comprising a cable transmitting the encoded image data and the control signal of the RSDS specification from the system to the control board.

8. The flat panel display of claim 1, wherein the transmission line transmits the encoded image data and the control signal of the RSDS specification from the control board to the first connecting member.

9. The flat panel display of claim 1, wherein the encoded image data and the control signal of the RSDS specification are directly transmitted from the system to the first connecting member.

10. A flat panel display, comprising:

a signal converting board including an analog/digital converter that converts an analog data having an analog format and forms a picture and a control signal for the analog data into a digital data and a digital control signal, an image processing part that decides a timing format of the digital data and generates a control signal for the digital data, and an encoder that encodes the digital data and the digital control signal output from the image processing part into encoded digital data and encoded digital control signal having a RSDS specification;

a display module in electrical communication with the signal converting board, said display module comprising:

a control board including a power supply part that converts a constant-voltage into a predetermined voltage level;

a gray scale generating part that generates a gray scale voltage using the predetermined voltage level of the voltage converting part;

a gate voltage generating part that generates a gate on/off voltage using the predetermined voltage level of the voltage converting part;

a transmission line that transmits the encoded digital data and the control signal;

a first connecting member having a data driver that generates a column signal from the image data, the control signal, and the gray scale voltage, wherein the data driver comprises a decoder to decode the encoded digital data and the encoded digital control signal into TTL data;

a second connecting member having a scan driver that generates a scan signal from the control signal and the gate on/off voltage; and a flat panel that displays an image using the scan signal and the column signal.

11. The flat panel display of claim 10, wherein said data driver decoder comprises:

a first decoding unit that decodes the encoded digital data and the encoded digital control signal into the TTL data;

a first register unit that temporarily stores the TTL data decoded by the first decoding unit; and a first signal processing unit that generates and outputs a column signal using the TTL data stored in the first register unit, the control signal, and the gray scale voltage.

12. The flat panel display of claim 11, wherein the digital data and the digital control signal are transmitted in a mixed signal within a single channel and after being decoded by the first decoding unit, the TTL data is divided to be stored at a first register and a second register of the first register unit and output to the first signal processing unit.

13. The flat panel display of claim 11, wherein the digital data and the digital control signal are separately transmitted through respective corresponding channels and after being respectively decoded by a first decoder and a second decoder of the first decoding unit the TTL data is divided to be stored at a third register and a fourth register of the first register unit and output to the first signal processing unit.

14. The flat panel display of claim 10, wherein said scan driver comprises:

a second decoding unit that decodes the encoded digital control signal;

a second register unit that temporarily stores the encoded digital control signal decoded by the second decoding unit; and a second signal processing unit that generates a scan signal using the decoded control signal stored in the second register unit and the gate on/off voltage.

15. The flat panel display of claim 10, wherein the encoded digital data and the control signal are mixed with the encoder and transmitted through a single channel.

16. The flat panel display of claim 10, further comprising a cable transmitting the encoded image data and the control signal having the RSDS specification from the signal converting board to the control board.

17. The flat panel display of claim 10, wherein the transmission line transmits the encoded image data and the control signal of the RSDS specification from the control board to the first connecting member.

18. The flat panel display of claim 10, wherein the encoded image data and the control signal having the RSDS specification are directly transmitted from the signal converting board to the first connecting member.

19. A flat panel display, comprising:

a flat panel display having a plurality of data lines and a plurality of scan lines formed in a matrix configuration;

a system including a image signal processing part, a power output part, and encoder part, wherein the image signal processing part generates a data signal and a control signal and the encoder part receives the data signal and the control signal and transmits RSDS signals; and a control board including a gray scale generating part, a gate voltage generation part, power supply part and connected to the flat panel display with a plurality of connecting members, wherein the plurality of connecting members include a plurality of column driver integrated circuits that receives RSDS signals from the encoder and decodes the RSDS signals into a TTL signal.

20. The flat panel display of claim 19, wherein the flat panel display is a liquid crystal display.

21. The flat panel display of claim 19, wherein the plurality of connecting members apply the RSDS signals to the corresponding column driver integrated circuits.

22. The flat panel display of claim 20, wherein the plurality of column driver integrated circuits convert the RSDS signals into the TTL signal and generates a driving signal.

23. The flat panel display of claim 19, wherein the TTL signal is converted into a column signal and output to the plurality of data lines.

24. The flat panel display of claim 19, wherein the column driver integrated circuit further comprises:

a first decoder connected to a data transmission channel that receives the RSDS signal from the encoder and converting into a first TTL signal;

a first register in electrical communication with the first decoder that temporally stores the first TTL signal;

a second decoder connected to a control signal transmission channel that receives the RSDS signal from the encoder and converting into a second TTL signal; and a second register in electrical communication with the second decoder that temporally stores the second TTL signal, controls the first register, and outputs control signals to a shift register that outputs a column signal.

25. The flat panel display of claim 24, wherein the first register selectively outputs signals to a data latch.

26. The flat panel display of claim 24, wherein the second register selectively outputs control signals to at least one of the first register, the shift register, a data latch a converter and a buffer.

27. The flat panel display of claim 19, further comprising a cable transmitting the RSDS signals from the system to the control board.

28. The flat panel display of claim 19, wherein the transmission line transmits the RSDS signals from the control board to the connecting members.

29. The flat panel display of claim 19, wherein the RSDS signals are directly transmitted from the system to the connecting members.

* * * * *